US011540605B2

(12) United States Patent
Wolf

(10) Patent No.: US 11,540,605 B2
(45) Date of Patent: Jan. 3, 2023

(54) WATCH AND JEWELRY TRAVEL CASE

(71) Applicant: Wolf 1834, Inglewood, CA (US)

(72) Inventor: Simon Wolf, Los Angeles, CA (US)

(73) Assignee: Wolf 1834, Ingelwood, CA (US)

( * ) Notice: Subject to any disclaimer, the term of this patent is extended or adjusted under 35 U.S.C. 154(b) by 673 days.

(21) Appl. No.: 16/535,020

(22) Filed: Aug. 7, 2019

(65) Prior Publication Data

US 2021/0037937 A1 Feb. 11, 2021

(51) Int. Cl.

| | |
|---|---|
| ***A45C 11/10*** | (2006.01) |
| ***A45C 5/02*** | (2006.01) |
| ***A45C 5/08*** | (2006.01) |
| ***A45C 11/16*** | (2006.01) |
| ***A45C 13/00*** | (2006.01) |
| ***A45C 13/10*** | (2006.01) |

(52) U.S. Cl.

CPC ..... *A45C 11/10* (2013.01); *A45C 5/02* (2013.01); *A45C 5/08* (2013.01); *A45C 11/16* (2013.01); *A45C 13/005* (2013.01); *A45C 13/1092* (2013.01)

(58) Field of Classification Search

CPC ..... A45C 11/10

See application file for complete search history.

(56) References Cited

U.S. PATENT DOCUMENTS 2,118,507 A * 5/1938 Guttman ..... A47F 7/03 248/116
4,726,469 A * 2/1988 Farber ..... B65D 85/40 215/358
6,048,099 A * 4/2000 Muffett ..... A45C 11/20 383/110
D525,786 S * 8/2006 Orlando ..... D3/269
2008/0295930 A1* 12/2008 Arcese ..... A45C 5/08 150/112
2014/0353177 A1* 12/2014 Senate ..... B65B 55/00 206/6.1

FOREIGN PATENT DOCUMENTS

CH 682444 A5 * 9/1993 ..... A45C 11/10
WO WO-2011098853 A1 * 8/2011 ..... A45C 11/10

OTHER PUBLICATIONS

Case Elegance: https://www.amazon.com/Monogrammed-Travel-Watch-Organizer-Leather/dp/B07KP4CMPN/ (Year: 2018).*
WO-2011098853-A1 translation (Year: 2011).*
CH-682444-A5 translation (Year: 1993).*

* cited by examiner

*Primary Examiner* — John K Fristoe, Jr.
*Assistant Examiner* — Justin Caudill
(74) *Attorney, Agent, or Firm* — Fulwider Patton LLP

(57) ABSTRACT

A watch roll travel case with a rigid housing and a removable cushion or cuff for supporting a plurality of watches inside the housing has a hidden storage container removably disposed in the cuff for storing jewelry and other valuables. The storage container has a clamshell design with an elongated cylindrical shape and is slidably received within an elongated bore running down the center of the cuff. The storage container may be covered with a fabric that matches the fabric on the exterior of the cuff to further conceal the presence of the container in the cuff.

16 Claims, 4 Drawing Sheets

WATCH AND JEWELRY TRAVEL CASE

BACKGROUND

This invention relates generally to a travel case for storing and organizing articles, in particular articles like watches and jewelry, and more particularly has reference to a watch roll travel case for storing and organizing watches for travel and housing an additional hidden container inside for storing other valuables like jewelry.

Watch roll travel cases are well known. They typically consist of a rigid outer housing in the form of a cylinder with a removable cuff or cushion inside for holding watches. The removable cushion fits securely inside the housing for storage, but can be removed from the housing to allow watches to be mounted on or removed from the cushion. A hinged lid formed in the sidewall of the housing allows access to the interior of the housing where the cushion is stored.

Persons who travel with watches of the type typically stored in a watch roll travel case often have jewelry or other small valuables to carry as well. Storing the jewelry for travel often requires the user to provide a separate jewelry storage case, which adds to the burden and cost of traveling, and also exposes the jewelry to an added risk of loss or theft because the extra case can be accidently misplaced while traveling and is often recognizable as a jewelry case by potential thieves looking for an easy target.

There is a need for a system that allows a traveler to safety and securely organize and store his or hers watches, jewelry and other valuables for travel in a way that is compact and convenient, where the valuables remain safely protected yet easily accessible, and which reduces the risk of loss or theft. The present invention satisfies these and other needs.

SUMMARY OF THE INVENTION

Briefly, and in general terms, the present invention relates to a new and improved travel case for organizing and storing watches, jewelry and other valuables, in the form of a watch roll with a hidden storage compartment for jewelry and other valuables inside a removable cushion or cuff which has the external look and feel of a conventional watch roll cuff to hide the fact that jewelry and other valuables besides watches are stored inside the case.

In one embodiment, the travel case includes an elongated housing with a sidewall, two ends and a hollow interior and a hinged lid disposed on the housing as part of the sidewall, the lid having open and closed positions and allowing access to the hollow interior of the housing when the lid is in the open position. An elongated cuff is configured to be removably disposed in the interior of the housing. The cuff has a circumferential exterior surface sized so that wrist watches can be securely wrapped therearound, and a longitudinal bore extending into the interior of the cuff. An elongated storage container is configured to be removably and slidably disposed in the longitudinal bore, the storage container having an open interior and a lid with open and closed positions that allow access to an open interior of the container when the lid is in an open position.

In a further embodiment, the housing, the cuff and the storage container each have a cylindrical shape, and the storage container and the longitudinal bore have the same diameter and length. The interior of the housing is preferably lined with fabric material and the housing preferably has a rigid sidewall. In yet another embodiment, the cuff and the storage container are covered in the same material.

In still another embodiment, the longitudinal bore extends axially through the cuff and is open at both ends. Preferably, the elongated cuff is formed of resilient material.

In yet another embodiment, the storage container is a clamshell container with two halves and a lid. A spring hinge or stitched hinge can be used for connecting the lid to the container, and the storage container preferably has a rigid exterior and a lining in the interior.

These and other features and advantages of the invention will become more apparent from the following detailed description, taken in conjunction with the accompanying drawings, which illustrate, by way of example, features of the invention.

DETAILED DESCRIPTION OF THE PREFERRED EMBODIMENTS

Figure 1:
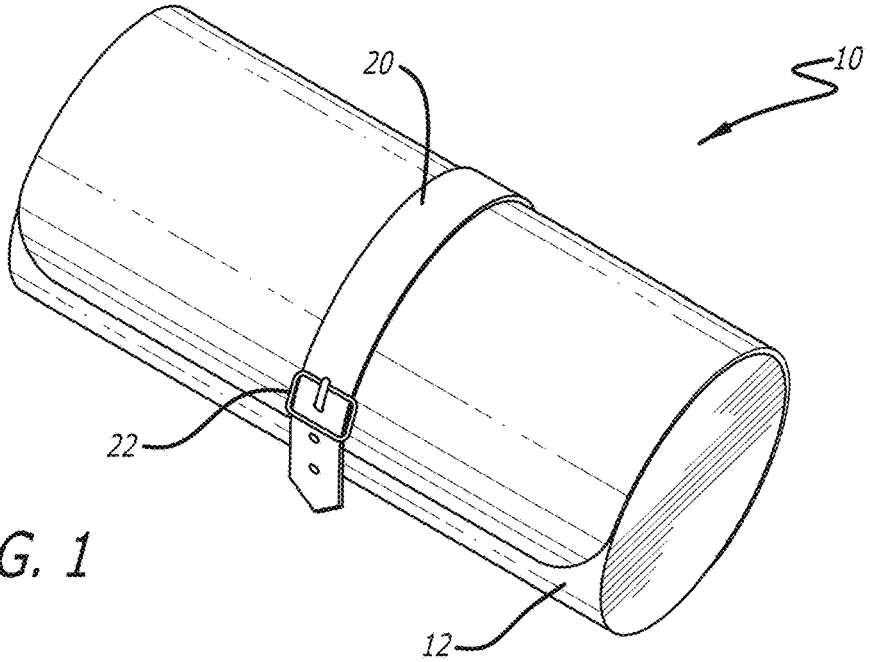
FIG. 1 is a perspective view of a watch travel case embodying novel features of the present invention, with the case in a closed condition.
Figure 2:
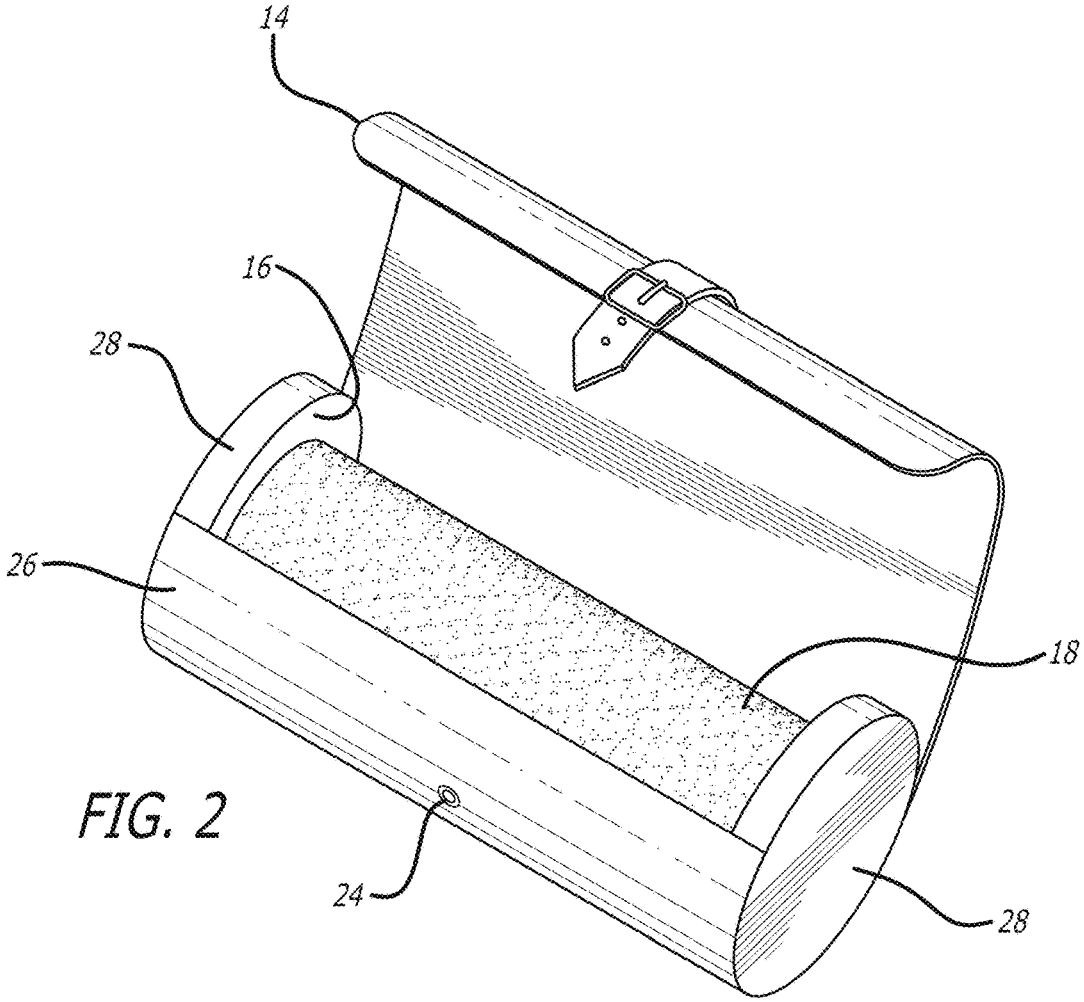
FIG. 2 is a perspective view of the travel case shown in FIG. 1, in an open condition.

Referring now to the drawings, and in particular to FIGS. 1 and 2, the invention is embodied in a watch roll travel and organizer case 10 of the type having a rigid cylindrical housing 12 with a hinged lid 14 that opens to expose a hollow interior 16 that securely fits a removable padded cushion or cuff 18 of cylindrical shape for holding watches. A closure mechanism, typically in the form of a strap 20 with a buckle 22 or snap fastener 24 is provided to secure the lid 14 when closed.

The housing 12 can be constructed from various materials, but is typically made of plastic, cardboard or similar rigid material wrapped in real or synthetic leather on the outside and lined on the inside with a soft suede, velvet, felt or flocked fabric lining to protect the contents inside the case 10 from scratches or other damage. While a rigid housing 12 is preferred for added protection, the housing could also be made of flexible leather or similar non-rigid material if desired. The case 10 is designed to be transportable and so is generally sized to easily fit in the hand of a user. A case 10 about eight inches long and about three inches in diameter would be typical, but the size can be varied to suit different needs and styles. It can be made shorter or longer, typically within a range of about two inches to about twenty four inches or more, and the diameter can vary from about one and a half inches to about eight inches.

The hinged lid 14 typically forms part of the sidewall 26 of the housing 12 when closed. The size of the lid 14 can vary, but it preferably extends for half the circumference of the sidewall 26 to provide a large enough opening for a user to easily insert and remove the cuff 18 from the interior 16 of the housing 12 yet retain the cuff securely inside the housing when the lid is open. The removable cuff 18, which is preferably made of resilient foam or similar compressible material covered in soft suede or other fabric that preferably matches the lining inside the housing 12, typically has a generally cylindrical shape and extends between base plates 28 on each end of the housing 12. The base plates 28 abut the ends of the cuff 18 to resist longitudinal movement when the cuff is nestled in place inside the housing 12. The cuff 18 preferably has a diameter that is smaller than the inside diameter of the housing 12 to allow room for watches to be mounted on the exterior of the cuff in a manner to be described, and is sufficiently long to hold one or more watches. The lid 14 is preferably secured when closed by a strap 20 fixed to the lid at one end, extending circumferentially across the outer surface of the lid, and removably secured to the housing 12 at the opposite end after the lid is closed. The strap 20 shown in FIGS. 1 and 2 has a non-functional decorative buckle 22 and is removably secured to the housing 12 by a conventional metal-plated snap fastener 24, with the male part (not shown) attached to the back side of the strap and the female part 24 mounted on the outside of the housing 12. Other types of closure mechanism can be used, if desired.

Figure 3:
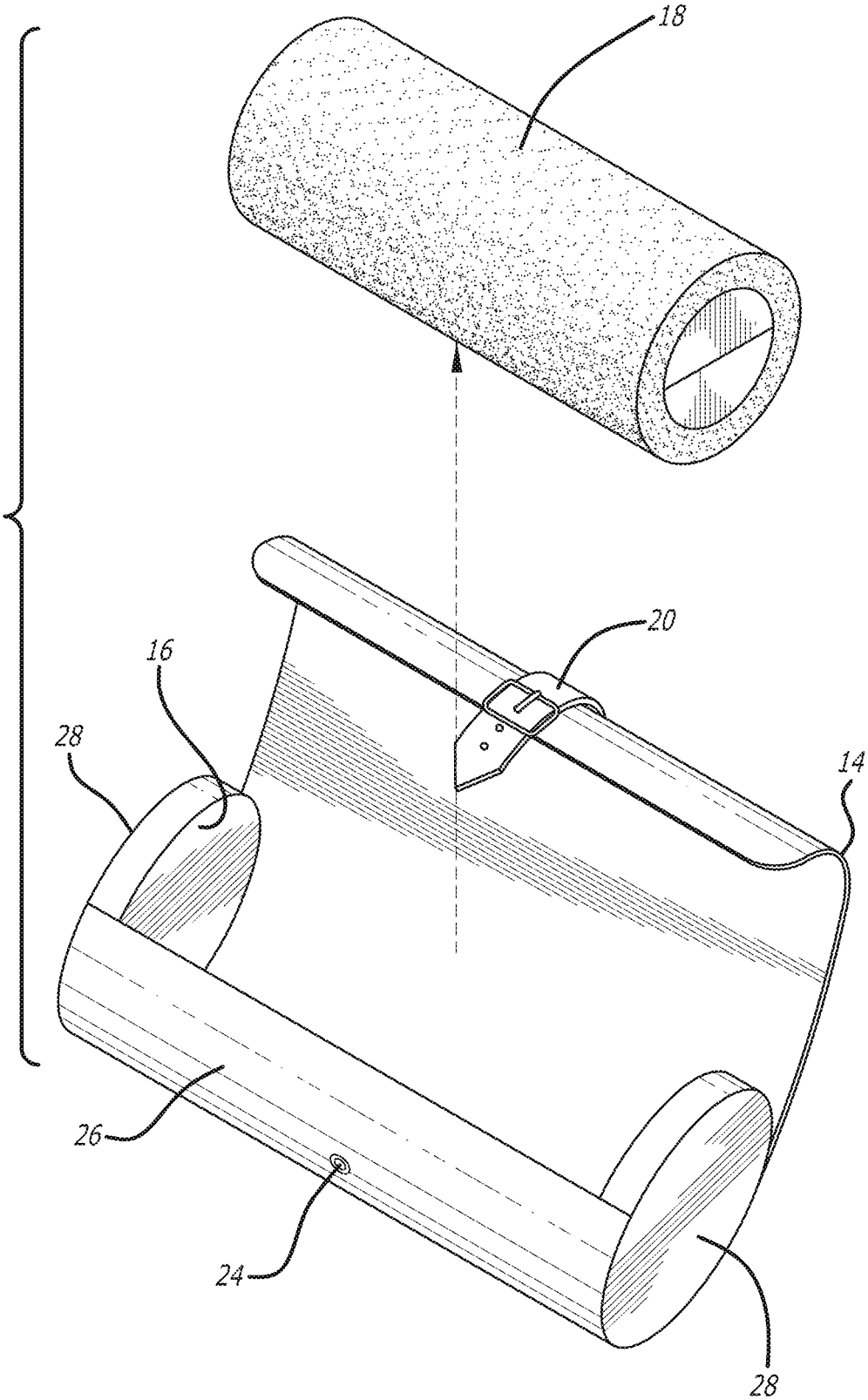
FIG. 3 is an exploded perspective view of the travel case shown in FIG. 1, with the cushion separated from the case.
Figure 4:
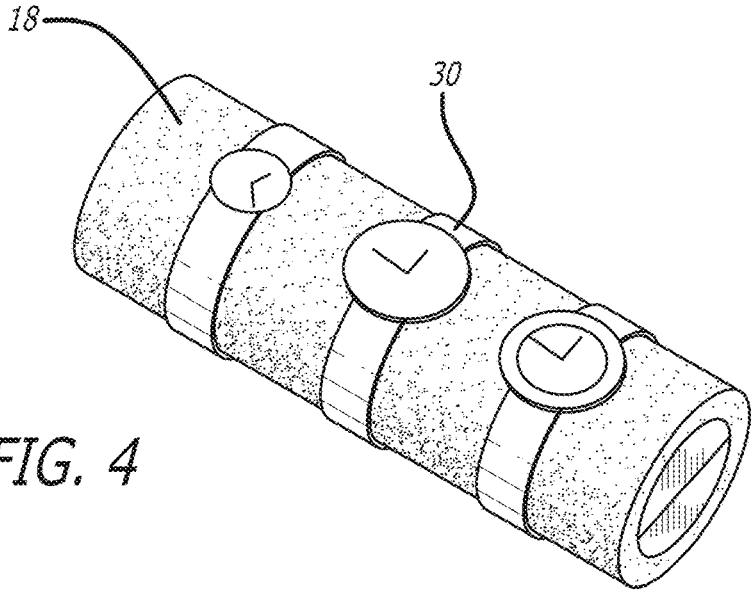
FIG. 4 is a perspective view of the cushion shown in FIG. 3, with three watches mounted thereon.
Figure 5:
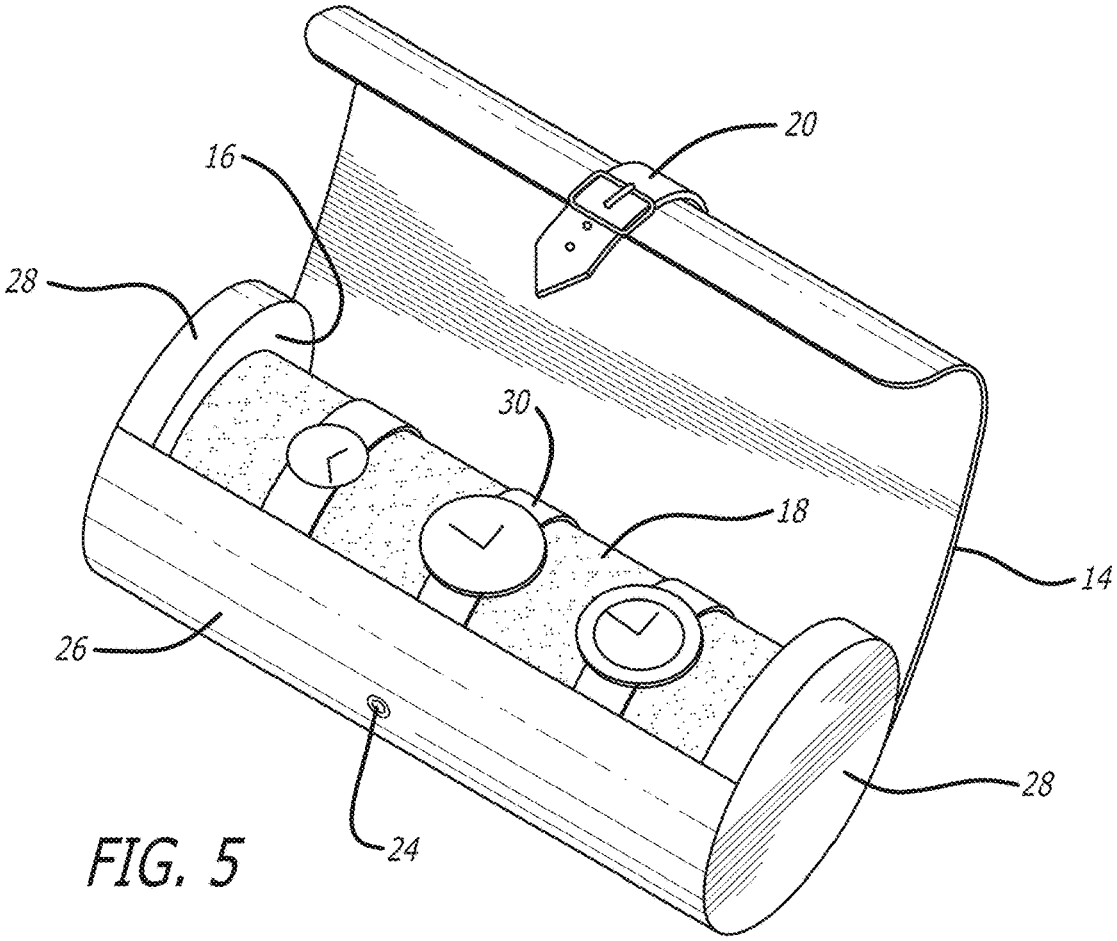
FIG. 5 is a perspective view of the travel case shown in FIG. 2, with three watches mounted on the cushion inside the case.

FIG. 3 shows the cuff 18 removed from the housing 12. Once the cuff 18 is removed, watches 30 can be mounted on the cuff 18 as best shown in FIG. 4. The watches 30 stay secured by being wrapped around the cuff 18 in the same way that the watches would be wrapped around the user's wrist when in use. The cuff 18 is sized to fit most sizes and styles of watches 30, large or small, men's or women's. While FIG. 4 shows three watches 30 mounted on the cuff 18, it will be appreciated that the cuff 18 can be sized to hold one, two, three or even more watches, if desired. Optional dividers (not shown) in the form of rings can be placed on the cuff 18 between the watches 30 to keep the watches from sliding around on the cuff 18 and potentially banging into each other. Once the watches 30 are secured on the cuff 18, the user can nestle the cuff 18 back into place inside the housing 12 as shown in FIG. 5, close the lid 14 then snap the fastener 24 closed as shown in FIG. 1, to keep the watches protected and secure inside the housing. While the cuff 18 is especially designed to hold watches 30, it will be apparent that other valuables like bracelets could be mounted on the cuff in addition to, or instead of watches, if desired.

Figure 6:
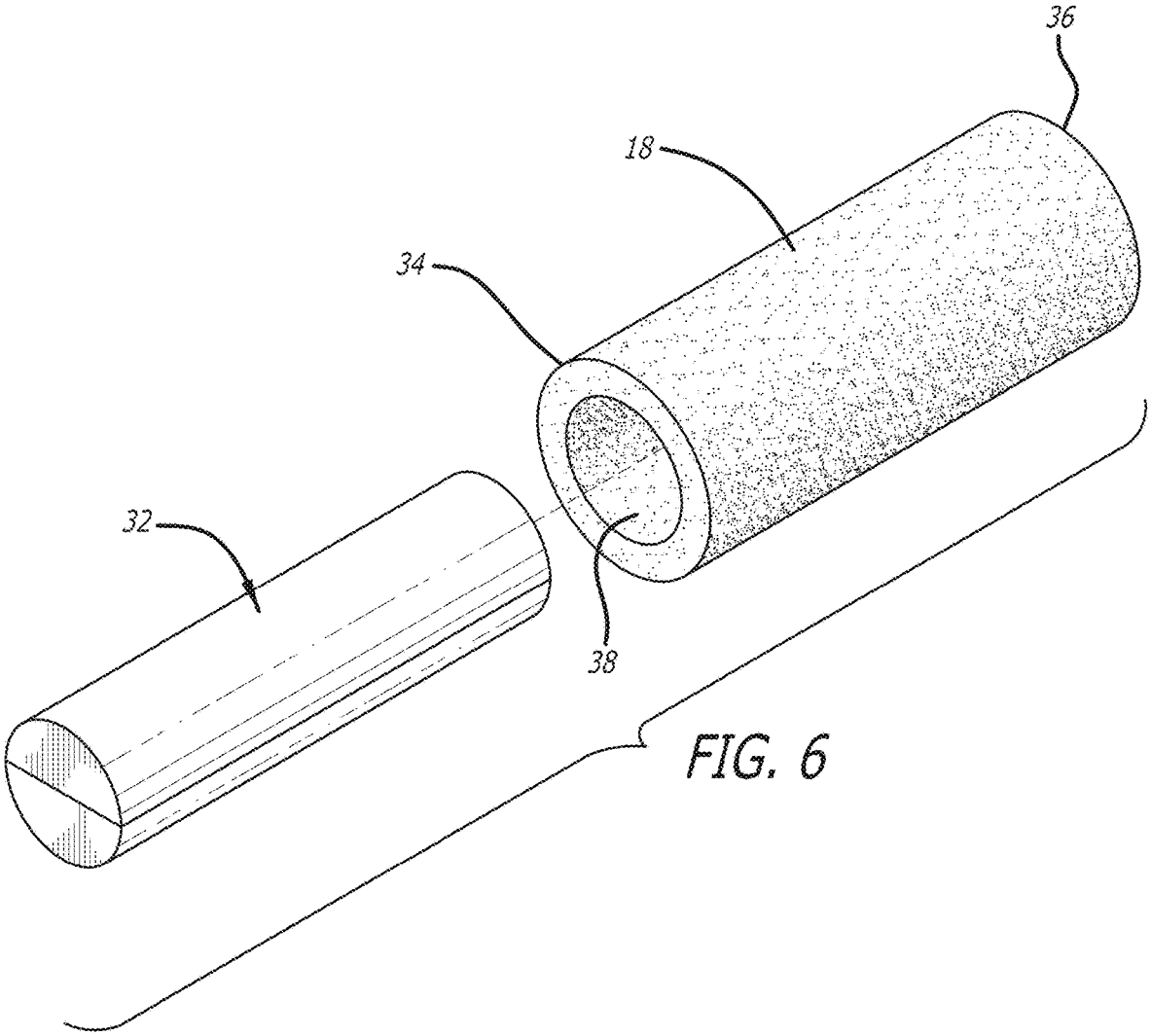
FIG. 6 is an exploded perspective view of the cushion shown in FIG. 3, with the central storage cylinder separated from the cushion and shown in a closed condition.
Figure 7:
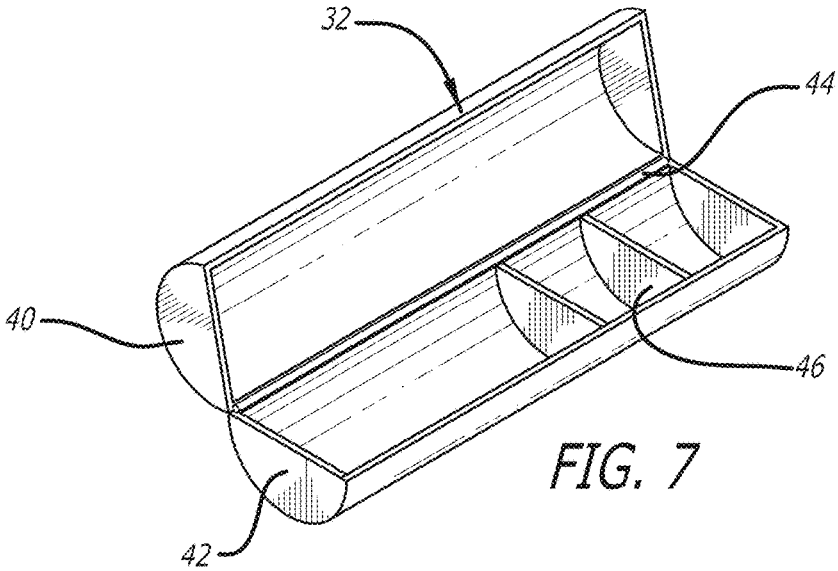
FIG. 7 is a perspective view of the central storage cylinder shown in FIG. 6, in an open condition.

As best shown in FIGS. 6 and 7, a separate interior storage container 32 is removably provided inside the cuff 18 for storing jewelry, time pieces and other valuables. In a preferred embodiment, the cuff 18 has the shape of a hollow tube with opposite ends 34 and 36, and the storage container 32 is in the form of a hollow elongated cylinder that slidably fits within an elongated bore 38 running longitudinally down the center of the tube. The bore 38 is preferably open at both ends 34 and 36 so that the container 32 can slide into or out of the bore from either end of the cuff 18. The container 32 preferably has the same length and diameter as the bore 38 for a snug but inconspicuous fit inside the cuff 18. While illustrated as circular, it will be appreciated that the container 32 can have other cross-sectional shapes such as, but not limited to square, rectangular, oblong, or even triangular, to name a few.

As best shown in FIG. 7, the container 32 is preferably a hard clamshell design with two halves 40 and 42 joined by a hinge 44. Various kinds of hinges can be used. In one embodiment, the hinge 44 can be a spring hinge 46 which allows the container to open and close securely and to stay open or closed. In an alternative embodiment, the hinge 46 can be a stitched hinge covered with a strip of leather or similar material. With a stitched hinge, it is often preferred to use hidden magnets (not shown) on the opposing surfaces of the clamshell halves 40 and 42 to hold the halves together when the container 32 is closed. It will be appreciated that other kinds of hinges can be used as well.

The hard shell exterior of the container 32 provides protection for the contents inside, while a soft interior lining made of padded felt-like or similar material guards the contents against dust and scratches and reduces the noise from contents moving around inside the container 32. The exterior of the container 32, which is preferably made of plastic or other rigid material, can be optionally covered along its length and at both ends which a real or imitation leather, or alternatively, with a fabric material that matches the fabric covering on the cuff 18 itself, to further conceal the existence of the container 32 inside the cuff 18. If desired, dividers 46 as shown in FIG. 7 can be arranged inside the container 32 to form compartments that keep the contents both organized and separated.

From the forgoing, it will be appreciated that a travel case incorporating the novel features of the present invention can be used to keep watches, time pieces, jewelry and other valuables secure and scuff/scratch free while at home and on the road. The case can store multiple watches in one place and keep them organized and protected. Moreover, the additional container 32 inside the cuff 18 is hidden from view so that a potential thief is unaware of its existence and can be fooled into thinking that the travel case is empty when no watches 30 are disposed on the cuff 18.

The present invention may, of course, be carried out in other specific ways than those that have been illustrated and described, without departing from the spirit and scope of the invention. The present embodiments are, therefore, to be considered in all respects as illustrative and not restrictive, while the scope of the invention is set forth in the claims that follow.

I claim:

1. A travel case for storing and organizing watches and other valuables like jewelry comprising:

an elongated housing with a sidewall, two ends defined by base plates permanently affixed to the housing, and a hollow interior;

a hinged lid disposed on the housing as part of the sidewall, the lid having open and closed positions and allowing access to the hollow interior of the housing when the lid is in the open position;

an elongated cuff configured to be removably disposed in the interior of the housing between the base plates, the cuff having two ends, a circumferential exterior surface sized so that a wrist watch can be securely wrapped therearound, and a longitudinal bore extending axially through the cuff with an opening at each end when the cuff is removed from the housing; and a removable storage container configured to be removably and slidably disposed into the longitudinal bore through the opening at either end of the cuff, the storage container having two ends, an open interior and a lid with open and closed positions that allow access to an open interior of the container when the lid is in the open position.

2. The apparatus of claim 1, wherein the housing, the cuff and the storage container each have a cylindrical shape.

3. The apparatus of claim 1, wherein the removable storage container and the longitudinal bore have the same diameter and length, and wherein the ends of the cuff and the ends of the removable storage container are covered in matching material to further conceal the storage container when disposed in the cuff.

4. The apparatus of claim 1, wherein the cuff has an elongated tubular shape with a cylindrical outer surface.

5. The apparatus of claim 1, wherein the removable storage container is a clamshell container with two halves and a lid.

6. The apparatus of claim 5, wherein a stitched hinge connects the lid to the container.

7. The apparatus of claim 5, wherein a spring hinge connects the lid to the container.

8. The apparatus of claim 1, wherein the removable storage container has a rigid exterior and a lining in the interior.

9. The apparatus of claim 1, wherein the longitudinal bore extends axially through the center of the cuff.

10. The apparatus of claim 1, further comprising a strap for holding the hinged lid in the closed position.

11. The apparatus of claim 1, wherein the elongated cuff is formed of resilient material.

12. The apparatus of claim 1, wherein the interior of the housing is lined with fabric material selected from the group consisting of suede, felt, velvet and flocked material.

13. The apparatus of claim 1, wherein the housing has a rigid sidewall.

14. The apparatus of claim 1, wherein the removable storage container is configured to have a snug friction fit in the longitudinal bore.

15. The apparatus of claim 1, wherein the removable storage container has an elongated shape with a cylindrical outer surface.

16. The apparatus of claim 1, wherein the removable storage container has a uniform shape extending from end to end along a longitudinal axis of the storage container.

* * * * *